US005437590A

United States Patent [19]

D'Alto

[11] Patent Number: 5,437,590

[45] Date of Patent: Aug. 1, 1995

[54] MULTIDIRECTIONAL COMBINATION BOXING AND KICKING BAG

[76] Inventor: Louis D'Alto, 11434 Ayrshire Rd., Brentwood, Calif. 90049

[21] Appl. No.: 202,692

[22] Filed: Feb. 14, 1994

Related U.S. Application Data

[63] Continuation-in-part of Ser. No. 152,827, Nov. 16, 1993, abandoned.

[51] Int. Cl.[6] ..... A63B 69/00

[52] U.S. Cl. ..... 482/90; 482/83; 482/87; 273/55 A

[58] Field of Search ..... 482/83-90; 273/55 A, 55 R, 26 R

[56] References Cited

U.S. PATENT DOCUMENTS

| | | | |
|---|---|---|---|
| 1,250,905 | 12/1917 | Liljergran | 273/55 A |
| 1,663,659 | 3/1928 | Hart et al. | 273/55 A |
| 2,197,545 | 4/1940 | Bachman et al. | 482/86 |
| 3,022,072 | 2/1962 | Zinnow | 482/90 |
| 4,593,900 | 6/1986 | Burke | 482/83 |
| 4,721,302 | 1/1988 | Murphy | 273/55 A |
| 4,989,867 | 2/1991 | Herrick | 273/26 R |
| 5,183,451 | 2/1993 | Hautamaki | 482/86 |
| 5,253,393 | 10/1993 | Levin | 482/90 |
| 5,277,679 | 1/1994 | Wells | 482/83 |

FOREIGN PATENT DOCUMENTS

| | | | |
|---|---|---|---|
| 1657213 | 6/1991 | U.S.S.R. | 482/83 |

*Primary Examiner*—Jerome W. Donnelly
*Attorney, Agent, or Firm*—Spensley Horn Jubas & Lubitz

[57] ABSTRACT

An improved exercise bag that freely allows a person to throw all variations of punches and kicks in combination. The flexibility is made possible by the internal structure of the bag and allows for a reaction of the directed punch or kick. Therefore, the bag has the ability to provide a person with a follow through, if so desired. Furthermore, the bags design allows for the placement of a variation of punches and kicks. Unique to this bag, it incorporates multiple uses of equipment into one bag. The bag is free standing enabling a person to exercise 360 degrees around the bag. Furthermore, the bag may also be made adjustable in height.

14 Claims, 4 Drawing Sheets

MULTIDIRECTIONAL COMBINATION BOXING AND KICKING BAG

RELATED APPLICATIONS

This is a continuation-in-part application of Ser. No. 08/152,827, filed Nov. 11, 1993, now abandoned.

FIELD OF INVENTION

This present invention relates to physical exercise and the sport of boxing, specifically to the equipment that is used for training.

DESCRIPTION OF PRIOR ART

Gymnasiums and exercise equipment outlets commonly have an assortment of boxing equipment. The equipment, however, is relatively typical, such as punching bags with limited modifications in structure and use. Also, these bags are limited in function, and the functions are unique to generally one bag. Generally, each type of bag encompasses one rhythm that may be mastered. However, this mastery may not be transferred to the use of a different bag. For example, a person may practice on a speed bag until he masters the timing of the bag. Then, the same person may use a heavy bag to master the power in his/her punch. The drawback of this approach is having to use all types of bags to establish a technique. At this point, the person may still not be able to integrate what they have learned with a single bag or opponent. Further to this, the attempt to make a bag that allows for combination punches has resulted in inadequate simulation of movement and the ability to follow-through with a punch or kick whenever a follow-through is desired.

SUMMARY OF THE INVENTION

According to preferred embodiments of the present invention, a boxing bag combines the possibility of throwing combination punches, utilizing the ability to include upper-cut punches and hook punches with a full radius of follow-through on both. This is made possible by the flexibility of the bag's internal structure. The bag can be used to include additional fighting or exercise technique. By this, the full use of boxing and/or kick combinations is possible. In particular embodiments, the structure of this bag also results in a more realistic simulation of the responsive movements of a person. As timing and movement is essential in boxing and other physical contact sports, this bag utilizes more accurately the motion and timing of an opponent. In further embodiments, the bag can be encircled by the person and can teach an integration of rhythm, power and timing, with the ability to be struck with an upper-cut and a hook punch. This is all incorporated into one piece of equipment which also simulates a human response impact of force more accurately than any other piece of equipment. Further to this, its cost is considerably less than using the combination of other pieces of equipment and does not need to be affixed to the floor or ceiling. Still further advantages will become apparent from a consideration of the ensuing description and drawings.

BRIEF DESCRIPTION OF THE DRAWINGS

A detailed description of the invention will be made with reference to the accompanying drawings, wherein like numerals designate corresponding parts in the several figures.

Figure 1:
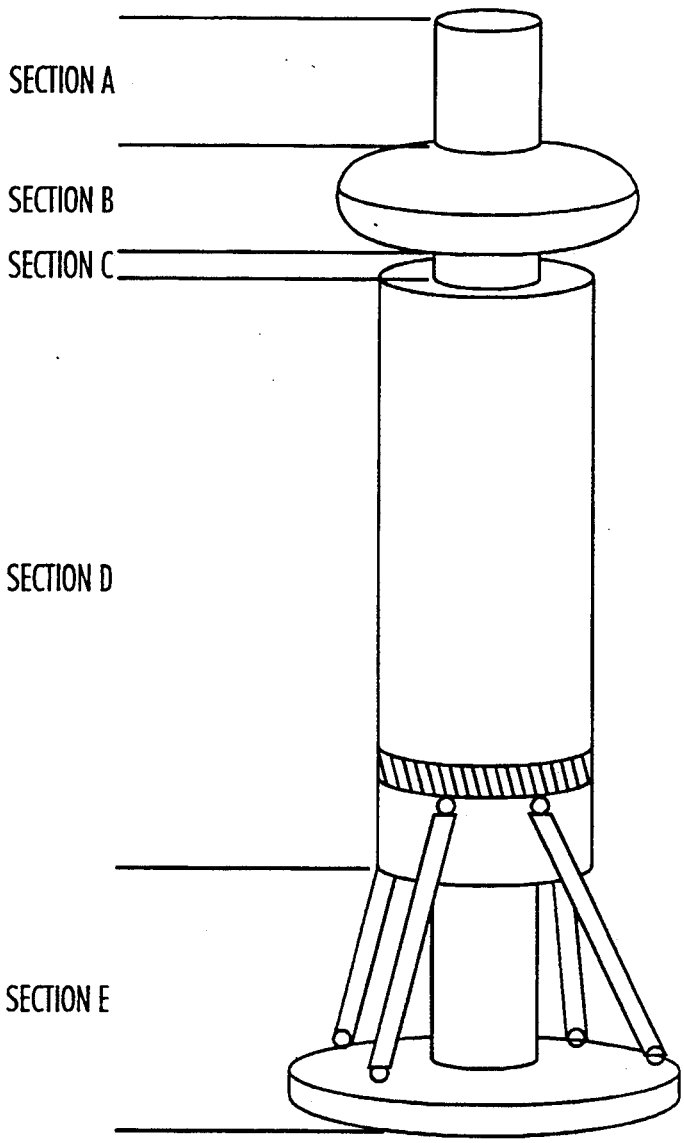
FIG. 1 shows the bag free standing, without tension from external force, and is illustrative of design and sections.

Note: The actual movement diagrammed is less extreme relative to the actual flexibility and interactive parts of the bag. However, the figures do allow for the conception of the idea that is being relayed.

DETAILED DESCRIPTION OF THE PREFERRED EMBODIMENTS

As shown in the drawings for purposes of illustration, the present invention is embodied in a multidirectional combination boxing and kicking bag. In preferred embodiments, the boxing and kicking bag can be used to train a boxer for a large number of conditions using a single bag. However, it will be recognized that the bag may be used to train students in other martial arts fields. For the convenience of the reader, the following labels and numerals will be used in association with the drawings to illustrate preferred embodiments of the present invention. Alphabetical suffixes:

Section A: the upper most part of the bag, being its head

Section B: the upper-cut collar pad

Section C: the neck of the upper-cut collar pad

Section D: the largest section of the bag, being its body

Section E: the lowest section of the bag, including its base

Numeric suffixes:

10 pipe, 11 flange, 12 Plexiglas, 13 flange, 14 pipe, 15 spring, 16 pipe, 17 spring, 18 pipe, 19 spring, 20 pipe,

21 flange, 22 steel shaft, 23 steel plate, 24 eye hooks, 25 bunge cords, 26 leather belt with steel ring attachments.

Figure 2:
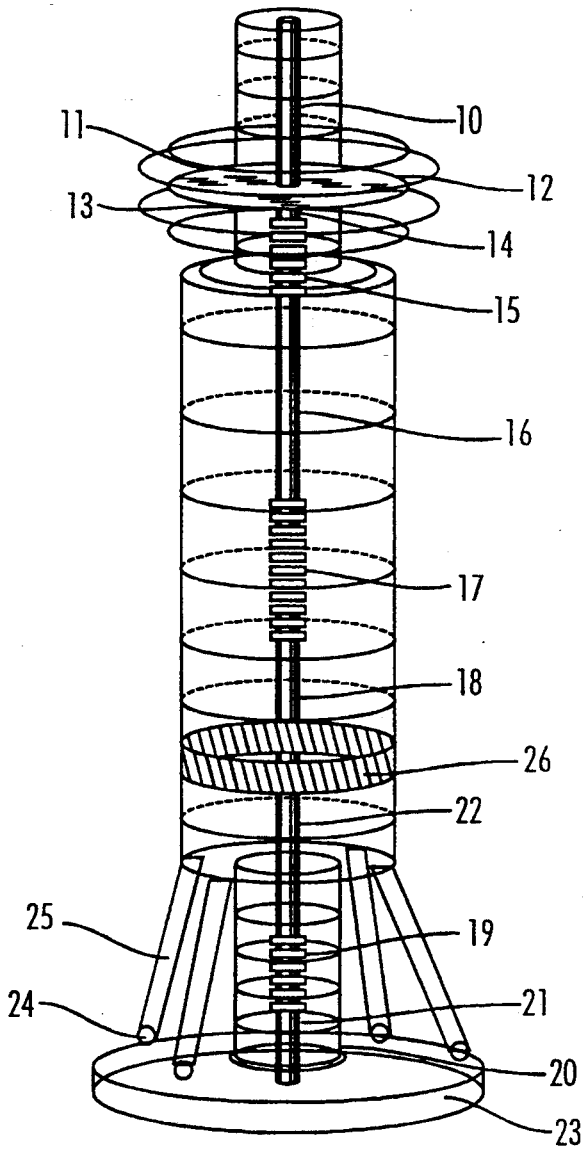
FIG. 2 shows the bag free standing, without tension from external force, and is illustrative of structure and numeric suffixes.
Figure 3:
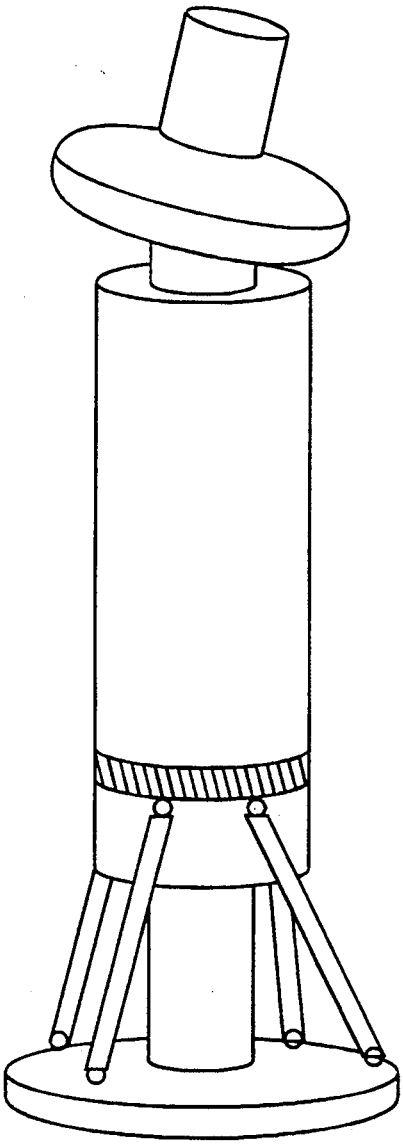
FIG. 3 shows the bag as it would react to momentum directed from a 90 degree angle to the diagram. (Thus, the person would be directing momentum from the right hand side of the bag in the diagram.) This example would result from a lead punch or an upper-cut. However the same motion of the bag would also result from a person directing momentum from the bottom side of the diagram (i.e., from a hook punch or roundhouse kick).
Figure 4:
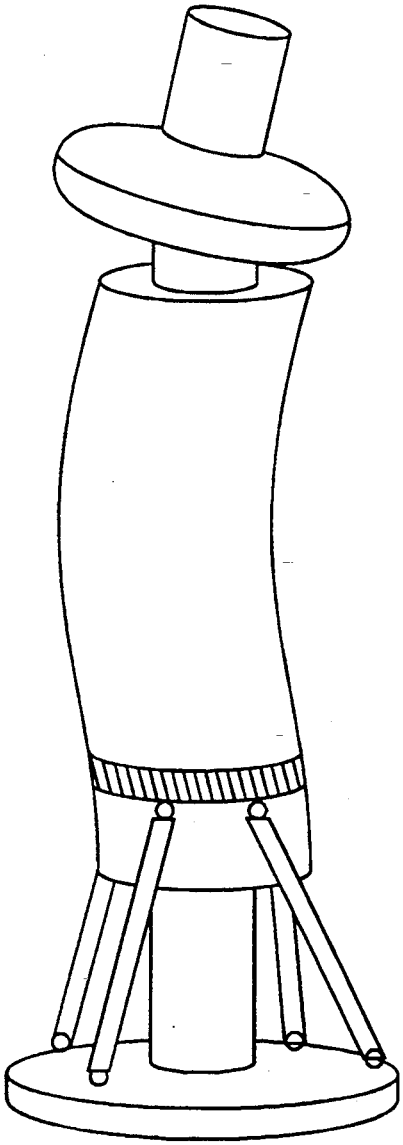
FIG. 4 shows the bag as it would react to momentum directed in a sideways or forward motion to the body (Section D). Simulation of head motion as it would result in a person. (Illustrated by the movement of Section A, B, C, and D.)

A typical embodiment of the bag is illustrated in FIG. 1 (illustrative of design) and FIG. 2 (illustrative of structure). The bag consists of sections, each made of components that utilize the advantages of a variance of alternate equipment. The pipe nipple, used as the main support, is a consistent 1½ inches thick throughout the bag. The illustrated piping nipple throughout this bag is the preferred embodiment. In alternative embodiments, the main supporting component can consist of any other unyielding material that can be used for support. However, the unyielding material should be combined with a spring, as used in the preferred embodiment, or with any other material that can be repeatedly bent without fracturing, such as rubber, plastic, fiberglass, graphite or their compounds, polyurethane or various other flexible materials, etc. The preferred embodiment of pipe and spring may even be eliminated to allow for a consistent solid material throughout the support structure. This can consist of any other material that can serve the same function, such as a fiberglass, graphite, compounded fiber and graphite, etc. However, the preferred embodiment is chosen due to the correlation of movement between the bag and that of a person.

The top section of the bag (Section A) is comprised of a 9 inch pipe nipple 10. This pipe is then screwed into a 1½ inch flange 11 (Section B) which is attached to a 14×1½ inch cut circular Plexiglas 12 (Section B). This male/female relationship has various possibilities with regard to the attachment of parts between pipe and other materials, such as a flange in this case. Threading may be formed directly upon the material that is accepting of a pipe to eliminate the flange. In the preferred embodiment, the upper cut collar is extended circularly by a Plexiglas sheet 12, as detailed above. However, this portion can consist of any other material that has the characteristic of hardness or any other means structural support to retain the shape of the portion (Section B) such as wood, plastic, aluminum, various metal compounds, etc. Also, the structural design of Section B may have a variety of shape or form. For example, the upper cut collar may be hexagonal, triangular, square, etc. in form or shape.

Coupled to the bottom of the Plexiglas 12 is another flange 13 attached opposite the side to the flange 11 above it. Screwed into the floor flange 13 is a 3 inch pipe 14. Around one end of the pipe 14 is a 10 inch spring 15 that is sized to be comfortably forged over 1½ inches of the lowest portion of pipe 14. The opposing end of the spring 15 is forged over 2½ inches of the upper most part of a 12 inch pipe 16. The result is 6 inches of space between pipes 14 and 16. This space, and other spaces relating to the distance between spring and pipe, may be increased, to allow for increased pliability. On a continuum, this space may be decreased for the opposite effect-decreased pliability. The lowest portion of the 12 inch pipe 16 (Section D) has a 10 inch spring 17 forged over it 2½ inches. The opposing end of the spring 17 is similarly forged 2½ inches over the highest point of a 23 inch pipe 18, resulting in a 5 inch space between the two previous pipes 16 and 18. The lowest portion of the pipe 18 has another 10 inch spring 19 forged 5½ inches over it. The opposing end of the spring 19 is forged over 1½ inches over a 4 inch pipe 20 (Section E). The result is a space of 3 inches between pipes 18 and 20. The lowest end of the pipe 20 is screwed into a flange that is secured into the center of a steel base 23 (Section E).

The base 23 weighs approximately 210 lbs. to secure the stability of the entire bag. In the preferred embodiment the base is circular in shape (24 inches in diameter×1½ inches in height) and constructed of steel. However, it may consist of other material that would provide for similar stability. It also may be rectangular, square or of varying shapes. A replacement for 23 can consist of a water filled sac, sand filled sac, an iron plate, a weigh disbursement structure, etc.

Ascending 24 inches through the inside of the pipes 18 and 20 is a solid steel shaft 22. The lowest section of the solid steel pole is secured 1½ inches in depth to the plate 23. The height or length of the steel shaft may not be limited to a specific length but should be long enough to provide the stability that is required in Section E. In the preferred embodiment the shaft serves to abate tautness (Section E) and act as a secondary stabilizer for the bag. However, the shaft could conceivably be of any other material of similar hardness and/or elasticity.

Spaced evenly around the plate 23 are four 4⅜ inch eye hooks 24. These eye hooks are spaced 1 inch inward from each equal distance of the the plate. They serve as attachments for nylon bunge cords 25, whose opposing ends are attached to four steel rings of a leather belt 26. The belt is secured tightly around the lower 7 inches of the bag portioned Section D. The cords 25 serve to further aid in controlling pliancy of the bag. However, the bunge cords may be replaced with material that would exhibit similar elastic responsiveness; or they may be eliminated from the cosmetic guise of the bag. Similarly, the leather belt may be replaced using nylon, plastic or any other corporeal that could be affixed to be of like application.

The actual size of the bag may vary by adjusting the components sizes, listed above. However, an adjustable base may be incorporated into the structure (Section E) during the preoperative construction of the bag. The preceding incorporation may consist of an adjustable piston and tube, assisted by hydraulics, gas, water or other aqueous material. To maintain the flexibility of the bag, flexibility was excluded by the vertical spring mechanism 19, the adjustment utilizes the use of one or more springs laid horizontally across the adjustment mechanism. The attachment of the horizontal spring or springs mechanism may replace the use of the single vertical spring, such as 15, 17, or 19, when combined with hinge and swivel. The hinge and swivel permits the movement of the bag, similar to the movement in the preferred embodiment. Similarly, the adjustment can be made to the uppercut mechanism as well as the center spring mechanism (Section D). This would allow the multidirectional movement of the bag; as in all three preceding sections discussed above. Thus, the incorporation of a hinge and swivel eliminates restrictive movement, enabling the bag to retain its movement as in the preferred embodiment. Also, the adaptation of an adjustment that uses a hinge and swivel mechanism would only be required when a vertical adjustment, such as a piston and tube, etc., is used. Therefore, the need for this mechanism, the spring and swivel, could be eliminated in Section C and D. The adjustment may also consist of a pin inserted through a vertically adjustable bar, etc. (Section C or Section E).

The insulator or filling of the bag is as follows: The upper most part of the bag (Section A) consists of 1½ inch imcolock pipe insulator, which is fitted over the top of the pipe 10. This is also consistent with the remaining pipe, 14, 16, 18, in Sections A, B, and C. Circuitously fitted over the imcolock insulator, in Section A, is fabricated Volara L-200 closed cell foam. The dimensions of the foam for Section A are 23½ inches×10 inches in height fabricated around the constant 3½ inch diameter section of the pipe and imcolock. Section B, consists of the same Volara foam, ½ inch×14 inches on the upper most portion. The lowest portion of Section B is 5 inches×14 inches of foam adhered with glue. Both preceding portions are affixed to 1½ inches×6 inches of foam wrapped around the circumference of the portions. Section C consists, of 22½ inches in circumference and 2 inches in height, of foam circuitously fitted over the portion of spring and pipe (Section C). Section D consists of two equal pieces. The first, measuring 17 inches in height and 41½ inches in circumference and placed over the upper most portion of Section D. Similarly, the second piece is placed over the lowest portion of Section D, thus leaving 1 inch of space to allow for the structural flexibility. Finally, the Sections A, B, C, and D are covered in leather; the leather is upolstered to fit each section. The padding of the bag may not be limited to imcolock and Volara L-200 foam. The padding may contain material that would provide a cushioning effect, such as water, cotton synthetic compounds, cotton compounds, foam rubber compounds, gaseous filler, etc. Similarly the external leather may be replaced with nylon, plastic, vinyl, rubber, etc.

From the description above, numerous advantages of the multidirectional combination boxing and kicking bag become apparent:

(a) A person can train on this bag, and virtually eliminate the need for training on combinations of other equipment.

(b) It may allow for a change in height, using the piston tube apparatus discussed previously, to supplement different sized persons.

(c) The responsive movements of the bag will allow a person to develop reflexive techniques of combination punches and kicks.

(d) The flexible response of the bag will allow for a follow through of a punch or kick.

(e) The bag need not be affixed to the floor or ceiling.

In addition to the preferred embodiment, electronic devices can be added to the embodiment. These devices contain an electronic program for training which does not exist on any other equipment specific to fight training within this conjecture. An LED, or similar type, includes a program profile which may includes:

1) Overall strikes per round goal
2) Actual strikes per round
3) Total number of strikes
4) Elapsed time
5) Average calories per round
6) Average overall calories
7) Round timer and bell The display is similar to the patented Life Fitness Inc.'s hill profile (U.S. Pat. No. 4,358,105). In the preferred embodiment, the program has the choice of three settings for levels of training. The instruction to begin exercise program follows:

1) press start
2) enter weight
3) press enter
4) enter level of skill-beginner, professional, and random
5) select program rounds (4–12) for professional level only; beginner level contains only three rounds
6) press enter Levels:

Beginner: the pace of the beginner program is a consistent sound (low pitch beeps) which will allow the person to concentrate on technique while still being required to throw strikes consistent with the sound.

Professional: the pace of the professional program is of varying sound (low to high pitch beeps) which follow the professional pace program as follows, however the pace of "toe to toe" progresses at low to high levels that are random.

This is done as follows: each section of the professional level program (1, 2, 3, and 4) allows for a varying range of pacing per rounds.

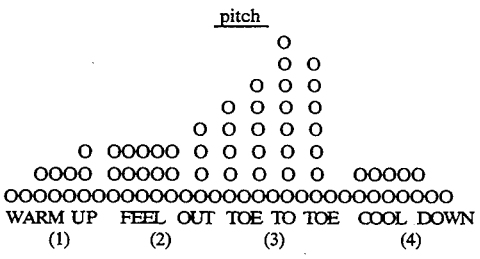

Random: the pace of the random program is of varying sound (low to high pitch beeps) which follow a pace chosen by the person exercising. Each section of the program will then be unpredictable, as the random program has been selected.

Each level has a preferred number of strikes per round, the higher levels include more strikes per round. On a continuum, the readout relays a digital light display of this training activity. It will record the activity on the display to illustrate what range of training the strikes were in. Thus, if the professional program is chosen and a strike or series of strikes were thrown above what the program suggests, it will be shown on the LED display which can then be compared with the program display. The above information is conducted by way of a 8150 processor base that utilizes 4 address lines and 4 data lines. The diagram labeled "Controller Block Diagram" illustrates the way in which the above information may be processed and utilized for the program desired. The data input, such as a punch, is relayed to the processor by means of "surface contacts" that are integrated beneath the outer most layer of the bag (Section A,B, and D of FIG. 1, Sheet 1). The "surface contacts" relay output by means of voltage to the processor. The processor is equipped with an internal AD. This graduates the transition of analog input to digital output. Its access memory receives information via panels of closing contacts beneath the outer layer of the bag using mylar or rubber connections with voltage pulse. The panels or grid contain sensors that relay contact information received from the person striking the bag. The signals are grouped in logic by means of a binary counter or pulser. The pulser or counter holds the pulse, samples and holds the gate circuit for an instant before relaying the frequency. This information is then conducted to the Firmware, where the 64K instrument articulates the information to the LED display in text and numerical information. This display may be mounted on the base of the bag (Section E of FIG. 1, Sheet 1). On a continuum, the display may also be mounted in an area detached from the bag. Information would then be relayed via cable, radio frequency, etc. Alternative displays, such as an electric dot matrix display, etc., may be used.

The same information may also be relayed to the user by means of a memory chip instead of the processor base described above. However, it is preferred that the processor base be used for its adaptability to programing changes.

While the description above refers to particular embodiments of the present invention, it will be understood that many modifications may be made without departing from the spirit thereof. The accompanying claims are intended to cover such modification as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

I claim:

1. A physical training device simulating an opponent's body and for receiving blows from a trainee, the device comprising:

a base for supporting the device on a supporting surface;

a central support structure having a plurality of substantially rigid rod members and a plurality of spaced apart elastomeric elongated members, wherein the plurality of rigid rod members are alternately spaced and coupled in co-linear alignment by the plurality of elastomeric elongated members, and wherein the central support structure is coupled to and vertically supported above the base;

a plurality of padded sections of various sizes and shapes to simulate the body of the opponent, the plurality of padded sections being disposed along and surrounding the central support structure such that the plurality of padded sections are supported by the central support structure, wherein each of the plurality of padded sections responds differently to the received blows, wherein the central support structure and the plurality of padded sections bend and flex to simulate a feel and a motion of the body of the opponent when a blow is received; and a plurality of resilient restoring cords coupled between the base and one of the plurality of padded sections to adjust the flexibility of the physical training device and to restore the central support structure and the plurality of padded sections to a pre-blow receiving orientation after receiving blows from the trainee.

2. A physical training device according to claim 1, wherein the plurality of resilient restoring cords are formed from an elastomeric material.

3. A physical training device according to claim 1, wherein the plurality of padded section include a torso simulating section for receiving and training the trainee in body blows.

4. A physical training device according to claim 3, wherein the plurality of resilient restoring cords are coupled to the torso simulating section.

5. A physical training device according to claim 3, wherein the plurality of padded sections further include a head section to simulate a head of the opponent for receiving head blows.

6. A physical training device according to claim 3, wherein the plurality of padded sections further include an upper-cut section for receiving and training the trainee in upper-cut blows.

7. A physical training device according to claim 6, wherein the plurality of padded sections further include a neck section for receiving and training the trainee in neck blows, and wherein the neck section is coupled between the upper-cut section and the torso simulating section.

8. A physical training device according to claim 1, wherein the plurality of padded sections are covered by a pliable material.

9. A physical training device according to claim 1, further including a belt surrounding and coupled to the one of the plurality of padded sections, and wherein the resilient restoring cords are coupled to the one of the plurality of padded sections by the belt.

10. A physical training device according to claim 1, wherein the plurality of rigid rod members are pipes, and wherein the plurality of elastomeric elongated members are springs.

11. A physical training device simulating an opponent's body and for receiving blows from a trainee, the device comprising:

a base for supporting the device on a supporting surface;

a central support structure having a plurality of substantially rigid rod members and a plurality of spaced apart elastomeric elongated members, wherein the plurality of rigid rod members are alternately spaced and coupled in co-linear alignment by the plurality of elastomeric elongated members, and wherein the central support structure is coupled to and vertically supported above the base;

a plurality of padded sections of various sizes and shapes to simulate the body of the opponent, the plurality of padded sections being disposed along and surrounding the central support structure such that the plurality of padded sections are supported by the central support structure, wherein each of the plurality of padded sections responds differently to the received blows, wherein the central support structure and the plurality of padded sections bend and flex to simulate a feel and a motion of the body of the opponent when a blow is received, wherein the plurality of padded sections include a head section for receiving head blows, an upper-cut section for receiving upper-cut blows, a neck section for receiving neck blows and a torso simulating section for receiving body blows, and wherein the head section is coupled to the upper-cut section, the upper-cut section is coupled to the neck section, and the neck section is coupled to the torso simulating section; and a plurality of elastomeric restoring cords coupled between the base and the torso simulating section of the plurality of padded sections to adjust the flexibility of the physical training device and to restore the central support structure and the plurality of padded sections to a pre-blow receiving orientation after receiving blows from the trainee.

12. A physical training device according to claim 11, wherein the plurality of padded sections are covered by a pliable material.

13. A physical training device according to claim 11, further including a belt surrounding and coupled to the torso simulating section of the plurality of padded sections, and wherein the elastomeric restoring cords are coupled to the torso simulating section by the belt.

14. A physical training device according to claim 11, wherein the plurality of rigid rod members are pipes, and wherein the plurality of elastomeric elongated members are springs.

* * * * *